US006793448B2

(12) United States Patent
Sain

(10) Patent No.: US 6,793,448 B2
(45) Date of Patent: Sep. 21, 2004

(54) ADAPTIVE RAILS FOR STACKING/ SECURING DIFFERENT SIZED SHIPPING CONTAINERS

(75) Inventor: Bernard S. Sain, Jacksonville, FL (US)

(73) Assignee: ITL Technologies, Inc., Jacksonville, FL (US)

( * ) Notice: Subject to any disclaimer, the term of this patent is extended or adjusted under 35 U.S.C. 154(b) by 40 days.

(21) Appl. No.: 10/279,979

(22) Filed: Oct. 25, 2002

(65) Prior Publication Data

US 2004/0081528 A1 Apr. 29, 2004

(51) Int. Cl.[7] ..... G60P 7/06
(52) U.S. Cl. ..... 410/46
(58) Field of Search ..... 410/46, 34, 35, 410/82, 77, 78, 68, 31, 32; 24/287; 206/503, 509; 220/1.5, 4.26, 4.27

(56) References Cited

U.S. PATENT DOCUMENTS

| | | | | | |
|---|---|---|---|---|---|
| 1,813,169 | A | | 7/1931 | Kellett | |
| 2,010,969 | A | | 8/1935 | Soulis | |
| 2,525,388 | A | | 2/1950 | Willetts | |
| 2,585,126 | A | | 3/1952 | Holland | |
| 2,851,963 | A | | 4/1958 | Sheehan | |
| 2,837,038 | A | | 10/1958 | Fahland | |
| 2,919,826 | A | * | 1/1960 | Richter | |
| 3,003,434 | A | | 7/1961 | Clejan | |
| 3,041,028 | A | | 3/1962 | McDowell | |
| 3,189,307 | A | | 6/1965 | Peterson | |
| 3,518,728 | A | * | 7/1970 | Phillips | |
| 3,543,951 | A | * | 12/1970 | Marvin | 214/10.5 |
| 3,632,145 | A | | 1/1972 | Davis | |
| 3,646,609 | A | * | 2/1972 | Bodenheimer | 220/1.5 |
| 3,776,169 | A | * | 12/1973 | Stecker | 214/10.5 |
| 4,648,764 | A | * | 3/1987 | Pavlick | 410/77 |
| 4,745,952 | A | * | 5/1988 | French | 410/35 |
| 4,986,705 | A | | 1/1991 | Durkin | |
| 5,183,375 | A | * | 2/1993 | Fenton et al. | 410/35 |
| 5,503,275 | A | * | 4/1996 | Fesquet | 206/509 |
| 5,560,663 | A | | 10/1996 | Hara et al. | |
| 6,027,291 | A | * | 2/2000 | Sain et al. | 410/35 |
| 6,129,396 | A | | 10/2000 | Asada et al. | |
| 6,336,765 | B1 | | 1/2002 | Watanabe | |
| 6,390,743 | B1 | | 5/2002 | Metternich | |
| 6,460,227 | B2 | | 10/2002 | Hove | |
| 6,572,325 | B2 | * | 6/2003 | Kelly | 220/1.5 |

* cited by examiner

*Primary Examiner*—D. Glenn Dayoan
*Assistant Examiner*—H. Gutman
(74) *Attorney, Agent, or Firm*—Foley & Lardner LLP

(57) ABSTRACT

In order to facilitate quick and easy stacking of containers of different sizes, adaptive rails are disposed on a row of containers of a first size and enable a row of containers of a different size to be placed on top of the first row. The adaptive rails are provided with guide surfaces/features which engage portions of the containers onto which they are placed or portions of the containers which are placed on the rails. This engagement forces the rail/container to slide into the requisite spatial relationship with the other of the rail/container and allows connection features to mate appropriately.

36 Claims, 13 Drawing Sheets

ADAPTIVE RAILS FOR STACKING/ SECURING DIFFERENT SIZED SHIPPING CONTAINERS

BACKGROUND OF THE INVENTION

1. Field of the Invention

The present invention relates generally to a stacking apparatus for shipping containers and more specifically to a stacking apparatus which is adapted to improve the speed and ease with which the stacking can be carried out.

2. Description of the Related Art

Cargo containers for overland and marine freight handling are produced in various standard sizes, including, among others, containers of 20, 40, 45, 48 and 53 feet lengths, as well as 96 inch and 102 inch widths.

These containers are typically provided with mounting fixtures used in securing the containers with respect to various vehicles or other cargo containers. The mounting fixtures are positioned in standard arrangements on both the top and bottom of the containers. For example, a conventional I.S.O. (International Standards Organization) cargo container is 40 feet long and 96 inches wide, and includes mounting fixtures at each of the four upper and four lower corners of the container.

U.S. Pat. No. 6,027,291 issued on Feb. 22, 2000 to Sain et al. discloses a stacking apparatus for containers which is adapted to enable the secure vertical stacking of at least one row of side-by-side upper cargo containers on top of at least one row of side-by-side differently sized lower cargo containers. This apparatus comprises at least two size adaptive rails. Each of these rails has a plurality of upper and lower mounting fixtures connected thereto so that the rail can be interposed between two rows of upper and lower stacked containers wherein one of the upper or the lower rows of containers is different in size (e.g. width) from the other of the upper or the lower rows of containers. The content of this Patent is hereby incorporated by reference thereto in its entirety.

When loading containers onto a vessel, for example, the containers are picked up and lowered into position using cranes and a device known as a spreader. The spreader is a coupling device adapted to be carried by the crane and to seat on and seize a container. Once engaged by the spreader, the container is easily lifted and placed in position. U.S. Pat. No. 6,129,396 issued to Asada et al. on Oct. 10, 2000, and U.S. Pat. No. 5,560,663 issued to Hara et al. on Oct. 1, 1996, disclose examples of spreaders and their use. The content of these patents are hereby incorporated by reference.

The spreader is also used to pick up and place the size adaptive rails in position. Two rails are taken at a time. After having secured the pair of rails with the spreader, the crane operator moves them into position over an existing row of containers. The operator then lowers the rails into position so that mounting fixtures on the containers and the rails interconnect with each other.

However, influences such as winds, and pendulous swinging of the spreader and rails due to inertial influences and the like as the crane moves the rails toward the containers, makes it difficult to achieve this precise disposition of the rails in exactly the right position on top of a row of two or more containers.

SUMMARY OF THE INVENTION

The present invention is directed to an adaptive rail arrangement which features guide members/features that facilitate the disposition of the rails in position on the upper sides of the aligned row of containers. The present invention is also directed to an adaptive rail arrangement which once in position on a row of containers is additionally/optionally equipped with guide members/features which facilitate the location and placement of the first of the next row of containers on top of the rails.

In one embodiment of the invention, the guide members take the form of corner guides which are provided at one end of each of the rails. As the rails closely approach the tops of a row of containers, the corner guides "cup" the corner of the endmost container of the row. These corner guides are provided with angled surfaces which, once engagement occurs, continuously force and guide the rails toward the required position as they are lowered into place.

With this positioning, the mounting fixtures on the lower side of the rails are aligned and positioned to mate with the mounting fixtures formed on the upper side of the containers onto which they have been lowered. Thus, as the adaptive rails are lowered onto the top of the underlying containers, the connection features engage in one another and enable the adaptive rails to be locked in the appropriate position.

A further embodiment of the invention provides guide skirts on the rails. These can be provided in addition to the corner guides, or used independently. By way of example, in the event that the row of containers onto which the rails are to be lowered span the full width of a container ship, it will be necessary to use a plurality of "pairs" of rails for that row. For example, assume that three rails, placed end to end, are necessary to span each upper edge of the row. The rail in the middle cannot be provided with a corner guide because of interference with the side-by-side placement of the containers. In this instance, side skirts alone can be used on the middle or intermediate rails to facilitate their placement.

A further embodiment of the invention resides in top guide members. One of these guide members is disposed on top of each of the rails that is located over the endmost container of the underlying row of-containers. These top guide members are disposed inwardly of the terminal ends of the rails and are located so as to guide the endmost container of the next row of containers (viz., the row to be disposed on top of the rails) into position. These top guide members have angled surfaces which engage a lower edge of the descending container and force it to move to a position wherein connection features on the lower side of the container become aligned with connection features provided on the upper side of the rails ensuring the appropriate penetration when the container seats on the uppers sides of the adaptive rails.

The above mentioned connection features include both elongate openings and twist lock connectors. The twist lock connectors are devices which extend into the openings and have lock members which can be rotated through 90° and lock the rails and containers together. In that these twist lock devices are well known in the art to which this invention is applicable, no specific description will be given. Reference, however, may be had to U.S. Pat. No. 6,460,227 issued in the name of Hove on Oct. 8, 2002, or U.S. Pat. No. 6,390,743 issued to Metternich on May 21, 2002 for description of such devices. The content of these patents is hereby incorporated by reference.

More specifically, a first aspect of the present invention resides in a method of stacking containers comprising the steps of: forming a first row of first containers; guiding rails to selected positions on opposite edges of the first row of first containers; interconnecting connection features on the rails to connection features on the containers of the first row of first containers; laying a second row of second containers on the rails; and interconnecting connection features on the rails to connection features on the containers of the second row of second containers. The two interconnecting steps can be carried out simultaneously.

In the above method, the step of guiding may comprises the steps of: providing a downwardly depending outwardly flared corner guide at one end of each of the rails; lowering the rails toward the first row of first containers; engaging the corner guides on the rails with corners of an endmost container of the first row of first containers; using the corner guides to force the rails to the preselected portions wherein engagement features on the first row of first containers mate with connection features on the rails on the first row of first containers as the rails continue to be lowered down onto the first row of first containers.

Alternatively, the step of guiding may comprise the steps of: providing a downwardly depending outwardly flared skirt along at least a portion of a side of the rails; engaging the sides of the first row of first containers with the skirts; and using the skirts to force the rails laterally with respect to the first row of first containers and toward the preselected portions as the rails continue to be lowered down onto the first row of first containers.

In addition to the above steps, the method may further comprise the steps of: providing a top guide on each rail proximate the end to which the corner guide is attached; and positioning each top guide so that an angled surface provided thereon is engageable with an endmost container of the second row of second containers as it is lowered toward the rails and for forcing the endmost container to a preselected position with respect to the first row of first containers.

A second aspect of the present invention resides in an apparatus for stacking a first row of first containers on top of a second row of second containers wherein at least one of the second row of second containers has one of a different width and a different length from at least one of the first row of first containers, the stacking apparatus comprising: a pair of rails each adapted to seat along a side of the second row of second containers; a downwardly depending outwardly flared corner guide at one end of each of the rails, each downwardly extending corner guide being adapted to engage a corner portion of an end container of the second row of second containers and to force the ends of the rails to predetermined positions on the end container as the rails are lowered down toward the second row of second containers.

In addition to the corner guides the above apparatus can further comprise: a downwardly depending outwardly flared skirt extending along at least a portion of the length of each rail, the skirt on each rail being respectively adapted to engage an upper edge surface of at least one of the second row of second containers and to force the rail toward a predetermined seating position on the second row of second containers.

This skirt can be detachably connected to the rail and it can either extend the full length of the rail, or can comprise skirt sections which are disposed along predetermined portions of the rail.

In addition to the skirt the apparatus can also comprise a top guide member secured to an upper edge of each of the pairs of rails, each top guide member having an angled surface adapted to engage a lower edge portion of an end container of the first row of first containers and to guide the end container of the first row of first containers toward a predetermined seating position on top of the pair of rails wherein connection features on the end container of the first row of first containers mate with connection features on the pair of rails.

Another aspect of the invention resides in an apparatus for stacking first containers on top of second containers, the stacking apparatus comprising: two elongated rails each having: at least one guide member connected thereto for engaging a portion of a first of the first and second containers and for forcing the rails to move into a predetermined seating position with respect to the other of the first and second containers as the rails approach the first of the first and second container and the at least one guide member on each rail, initially engages the first of the first and second containers.

In accordance with this aspect of the invention the above-mentioned at least one guide member can be detachably connected to a rail and comprise one of a corner guide member; a skirt member; and a top guide member which is secured to an upper surface of a rail and which has an angled surface which upwardly at a predetermined angle.

BRIEF DESCRIPTION OF THE DRAWINGS

The various aspects and advantages of the embodiments of the invention will become more clearly appreciated as a detailed description of the preferred embodiments of the invention are given with reference to the appended drawings in which.

DETAILED DESCRIPTION OF THE PREFERRED EMBODIMENTS

Figure 1:
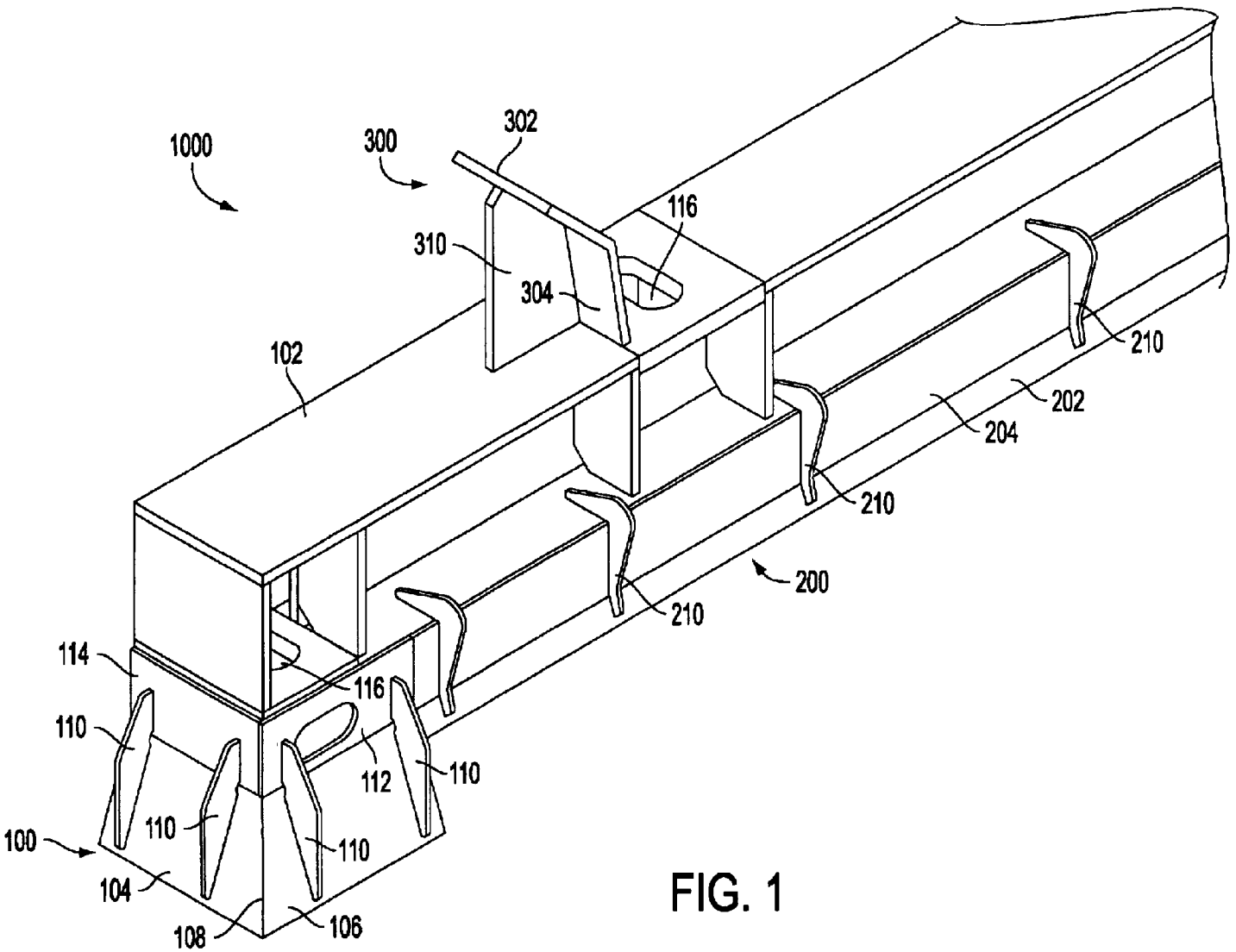
FIG. 1 is a perspective view of a rail according to the present invention which is provided with a corner guide and skirt which are used to guide the rail down into position on a side of the container, and which further depicts an optional top guide bracket.

FIG. 1 is a perspective view showing an I-beam rail 1000, which is, for illustrative purposes, shown equipped with first, second and third embodiments of the guide features according to the invention.

The first embodiment of the guide members, is a corner guide which is generally denoted with the numeral 100. In this case the corner guide 100 is permanently connected to the terminal end of the I-beam 102, and comprises first and second downwardly depending outwardly flared angled plates 104, 106 which are angled and shaped in the manner illustrated in FIGS. 1-6. The plates 104, 106 are welded or otherwise joined together to form an edge 108, and are respectively provided with reinforcing ribs 110. The corner guides further comprise vertical plate members 112, 114 which respectively interconnect the angled plates 104, 106 to the I-beam 102.

Figure 11:
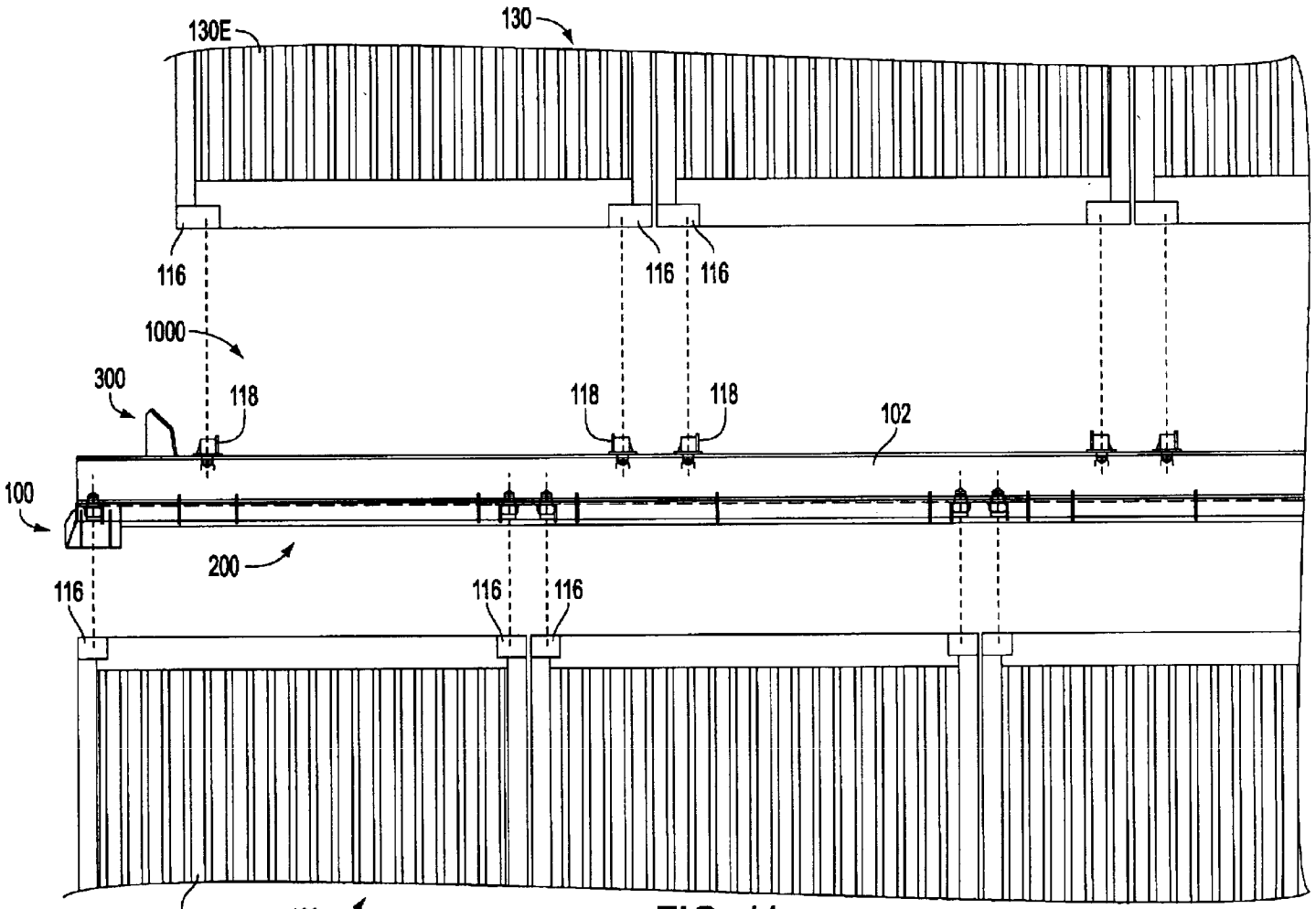
FIG. 11 is a side view depicting the manner in which the containers and rail features align with the connection features on the containers.
Figure 12:
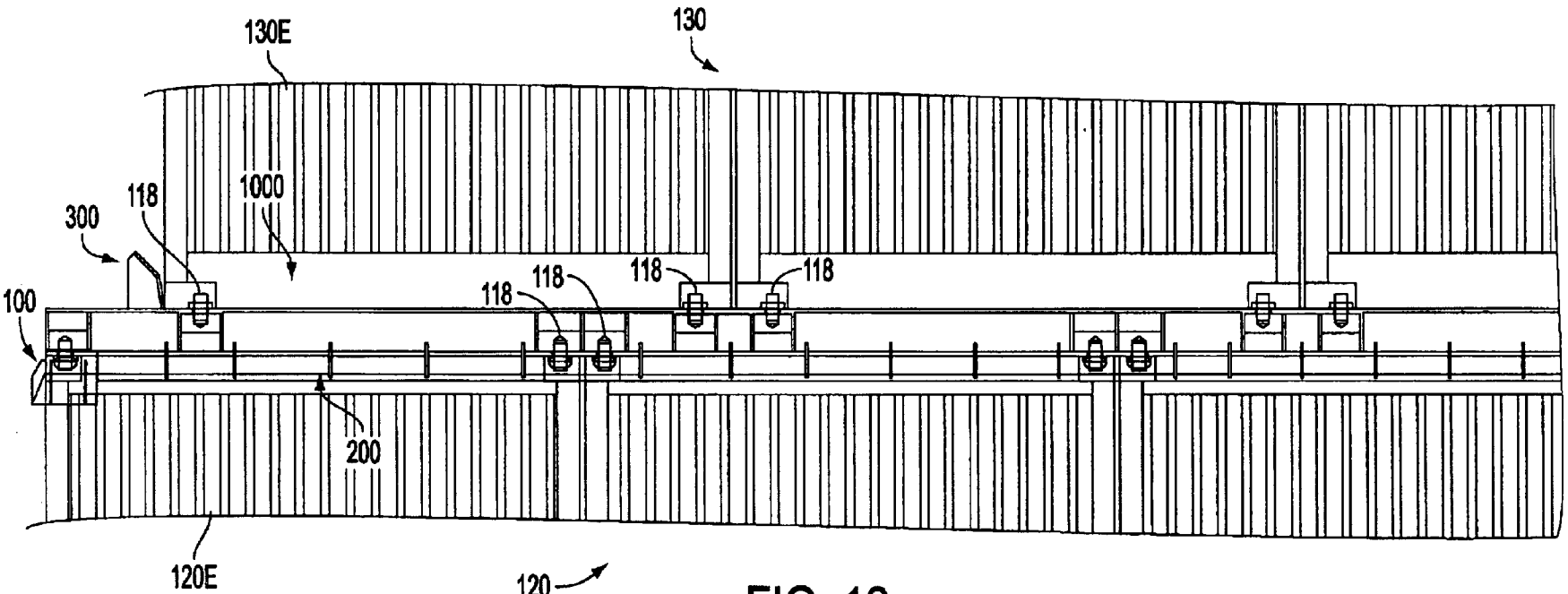
FIG. 12 is a side view showing the beam according to the present invention interconnecting different sized containers.

This corner guide 100 "cups" or encloses an external periphery of a corner of the endmost container of the row, toward which the adaptive I-beam rail 1000 is being lowered. This provides a funneling/guiding effect and enables the placement such as depicted in FIGS. 11 and 12. The crane operator, having two rails 1000 each equipped with these corner guides 100, can therefore lower the spreader (not shown) to the point where one of the two corner guides 100 engages an upper corner of the endmost container 120E of the row and thereafter rely on this engagement to bring the other corner guide into a similar engaging state. By continuing to lower the rails 1000 the situation is brought about wherein the vertical plates 112, 114 slide along the sides of the endmost container 120E and the rails seat on the aligned row of containers 120 with the connection features 116 (elongate openings) and connection features 118 (twist locks of the like type of connector) engaged in one another.

Figure 7:
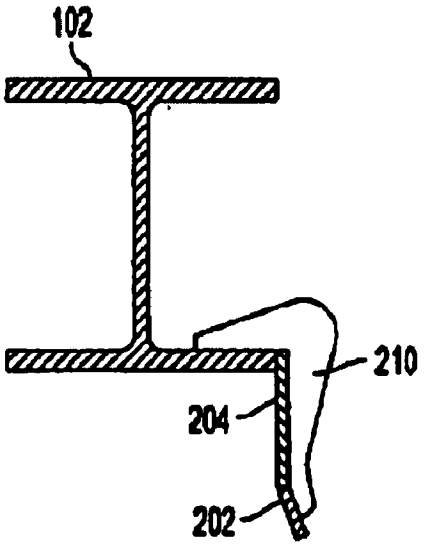
FIG. 7 is a sectional view taken along section line 7—7 of FIG. 3.
Figure 6:
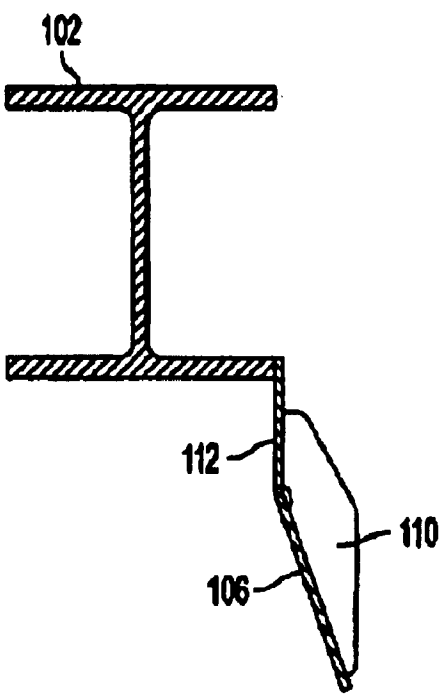
FIG. 6 is a sectional view taken along section line 6—6 of FIG. 3.
Figure 5:
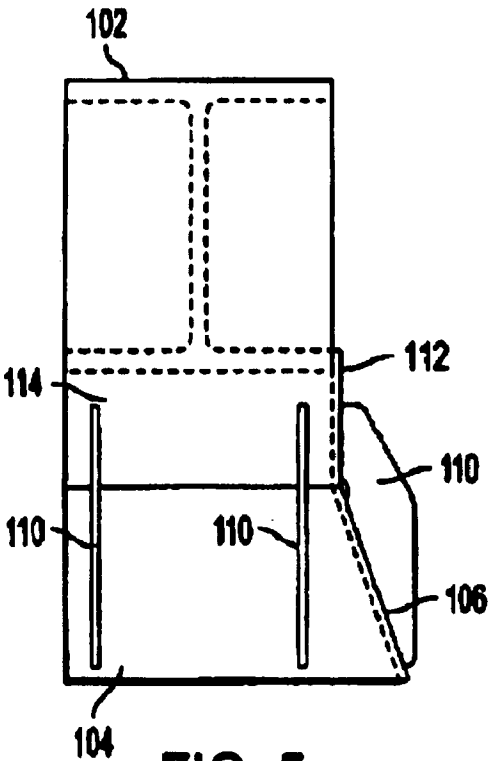
FIG. 5 is a end view of the rail show in FIGS. 1 and 2, showing the corner guide at the end of the I-beam.
Figure 9:
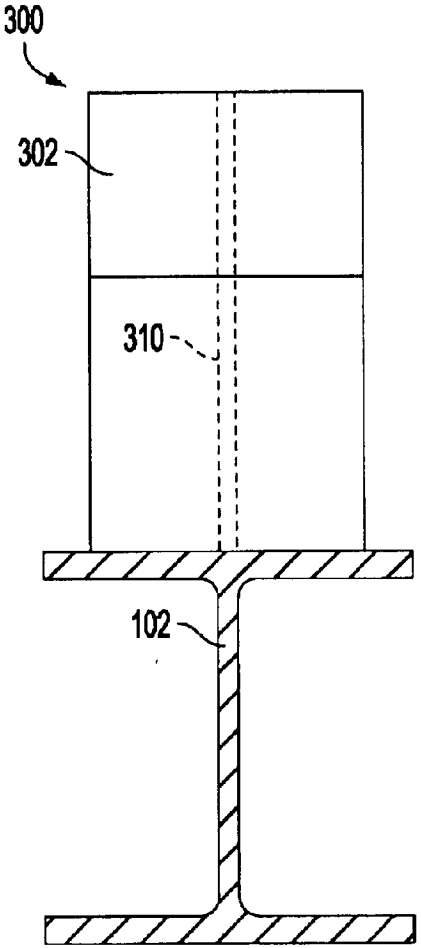
FIG. 9 is a sectional view taken along section line 9—9 of FIG. 8.
Figure 8:
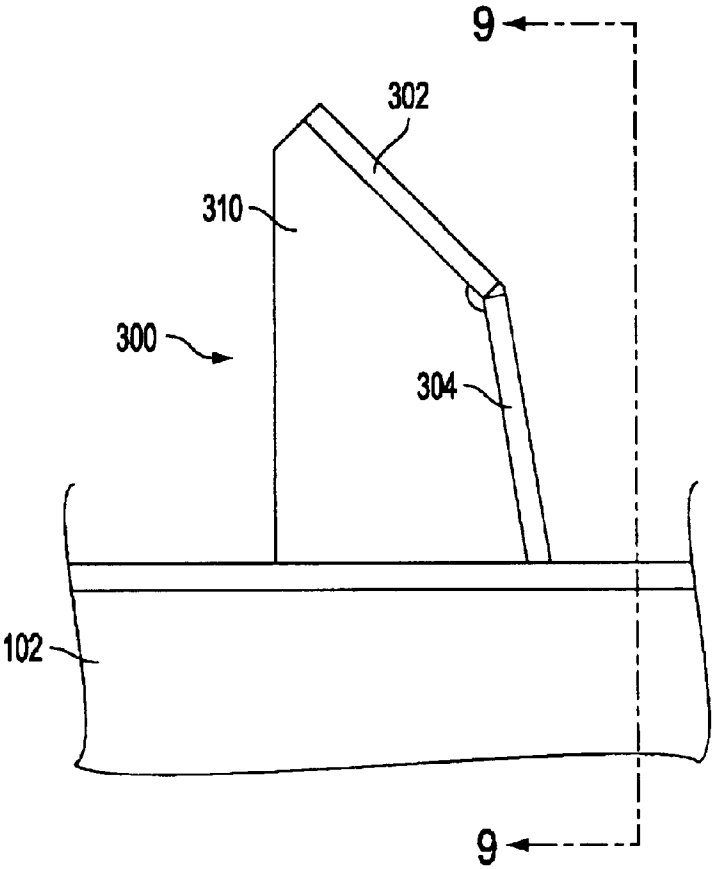
FIG. 8 is a side view of the top guide bracket.

The second embodiment of the guide members comprises a side skirt 200. This skirt 200 is welded and permanently fixed to a lower side edge of the I-beam 102 and has, as best appreciated from FIG. 7, an outwardly flared lower lip 202. Reinforcing ribs 210 are welded to the outer surface of the skirt 200 at predetermined intervals. These ribs 210 provide the necessary resistance to outward buckling of the skirt proper.

The skirt 200 also an upright portion or member 204. This upright member 204 provides the final locating effect once the angled or flared lip 202 has provided its funnel-guiding, location-forcing effect.

Figure 2:
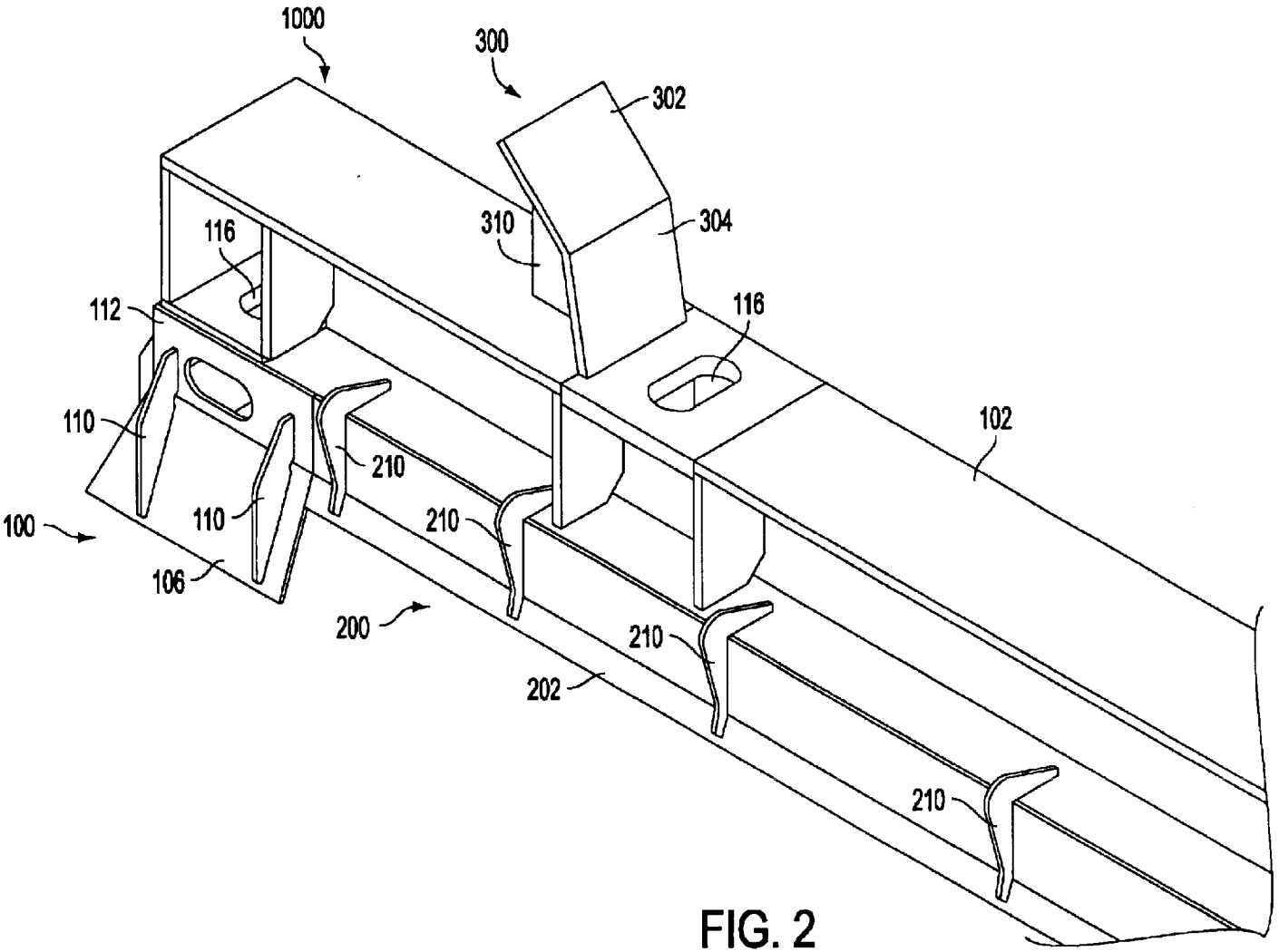
FIG. 2 is a second perspective of the rail shown in FIG. 1 taken from a different angle.
Figure 3:
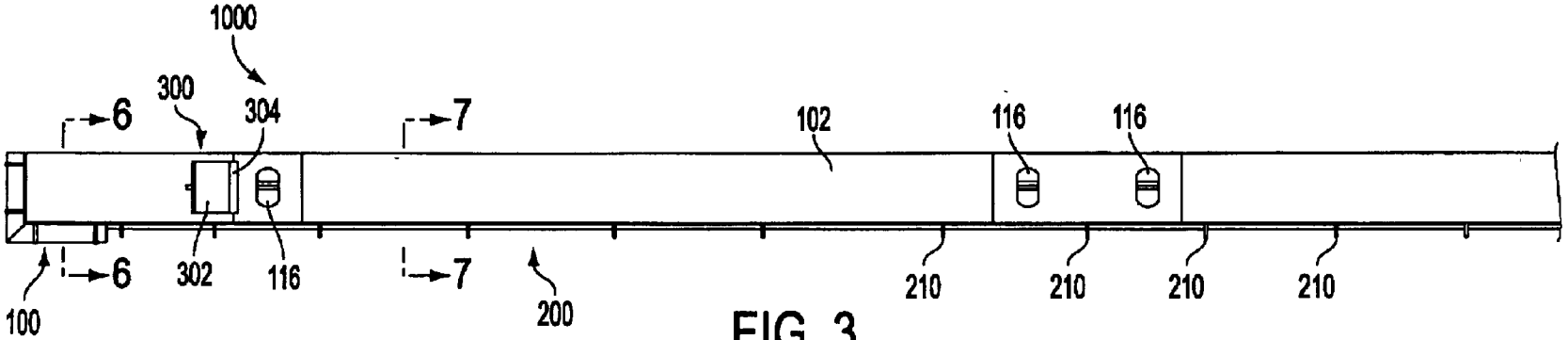
FIG. 3 is a plan view of the rail shown in, FIGS. 1 and 2
Figure 4:
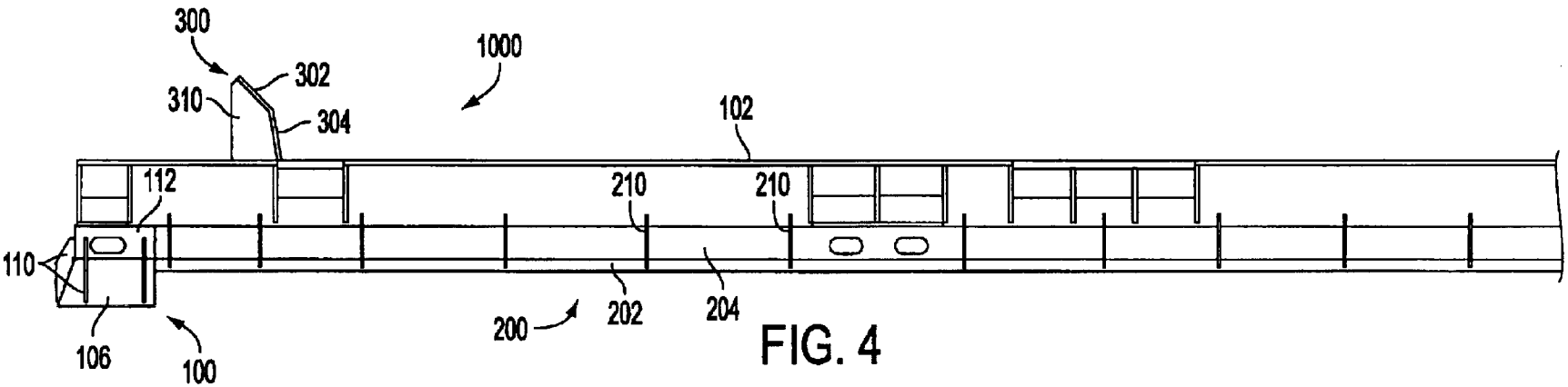
FIG. 4 is a side view of the rail shown in FIGS. 1–3.

The third embodiment of the guide members comprises a top guide 300. As best seen in FIG. 2, the top guide 300 has first angled guide surface 302 and a less angled, almost upright surface 304. A central web or rib 310 is provided to establish the necessary structural rigidity against forces acting in the direction of the terminal end of the I-beam 102 that is to say, the end on which the corner connector is located). The angles of the angled guide surfaces 302 and 304 are selected to impart an appropriate stepped guiding force to the lower edge of a descending endmost container 130E of a row of containers 130 which is being lowered onto the beam 102 (see FIGS. 11 and 12).

Figure 10:
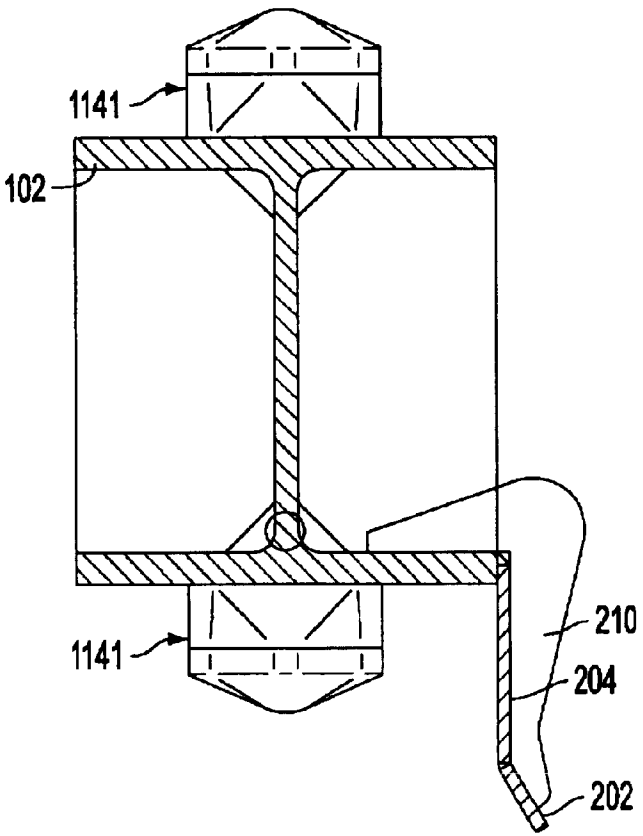
FIG. 10 is a sectional view of the I beam showing a so called "twist lock" device disposed in position in the beam for connecting containers, above and below the beam, to the beam.

FIG. 10 is a sectional view which shows a twist lock members 1141 which are permanently secured to the upper and lower surfaces of the adaptive rails 1000. This provision allows the rail 1000 to be used as a unit and obviates the need for the individual insertion/removal of these connectors during loading and unloading.

As will be appreciated, each rail 1000 can be guided and lowered into position on a row of containers (e.g. row 120 in FIG. 11). The next row of containers 130 can then be then loaded on top of the adaptive rails 1000 and the twist locks 1141 sequentially set to their locking positions. This, of course, enables efficient loading/unloading.

Figure 14:
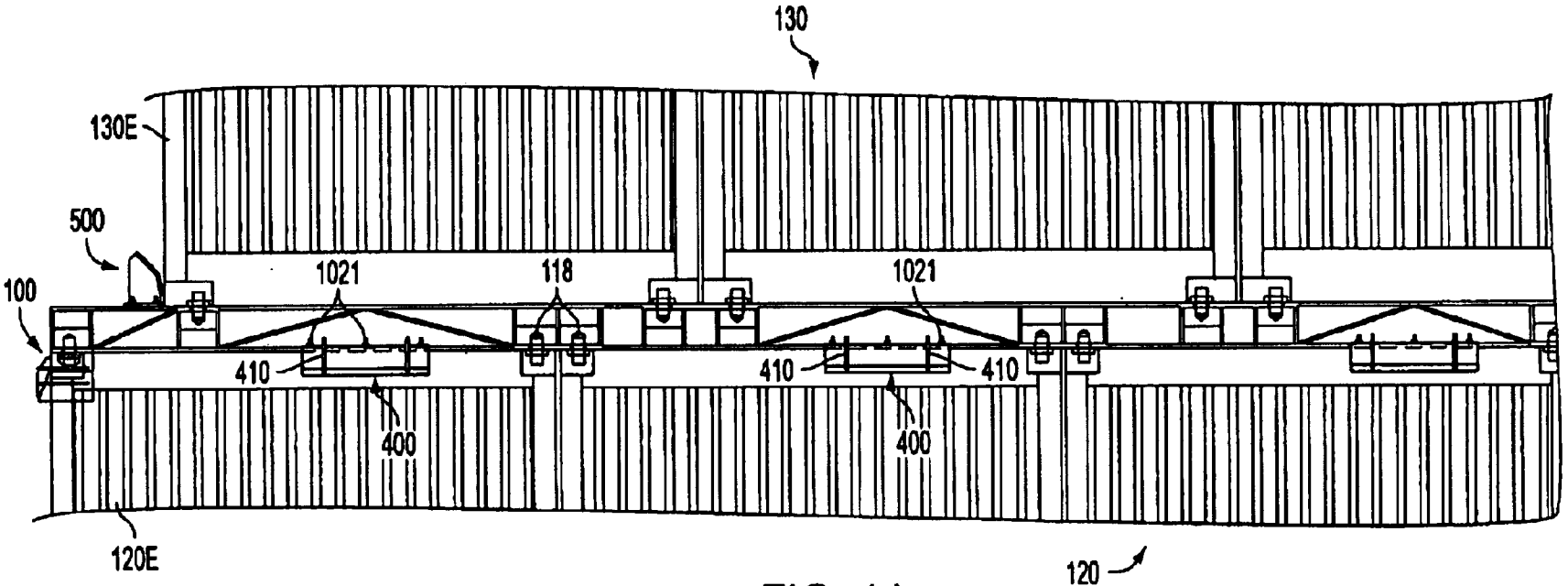
FIG. 14 is a side view showing an embodiment of the adaptive rails wherein a plurality of removable side skirts are detachably connected to each rail.
Figure 17:
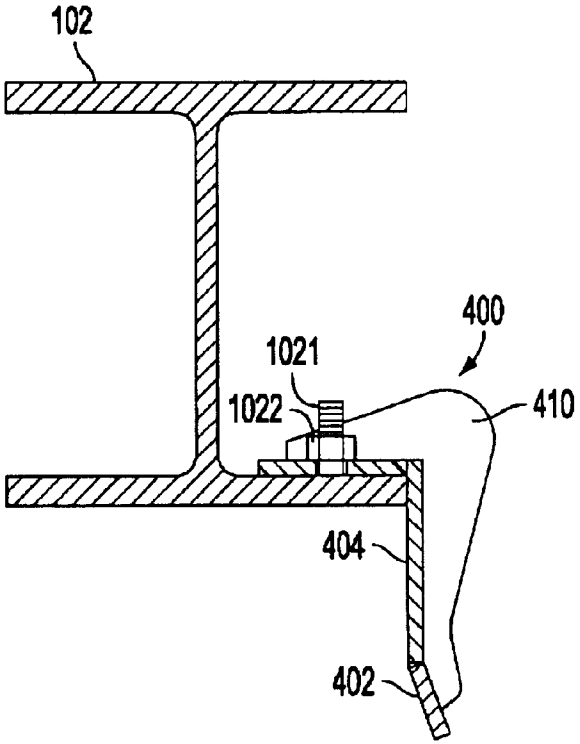
FIG. 17 is a sectional view of the rail shown in FIGS. 14 and 15, depicting the manner in which the side skirts are bolted to the beam proper to permit selective connection/removal.

FIG. 14 shows a variant of the second embodiment. In this arrangement, the elongate single piece permanently connected skirt 200 is replaced with abbreviated short skirt members generally denoted by the numeral 400. These skirtlets 400 (as they will be referred to) are adapted to be removable. As best seen in FIG. 17, the I-beams have studs 1021 welded thereto in the illustrated positions and facilitate the connection of the skirtlets 400 via the simple application of nuts 1022. These skirtlets 400 are also provided with strengthening/reinforcing ribs 410.

Figure 15:
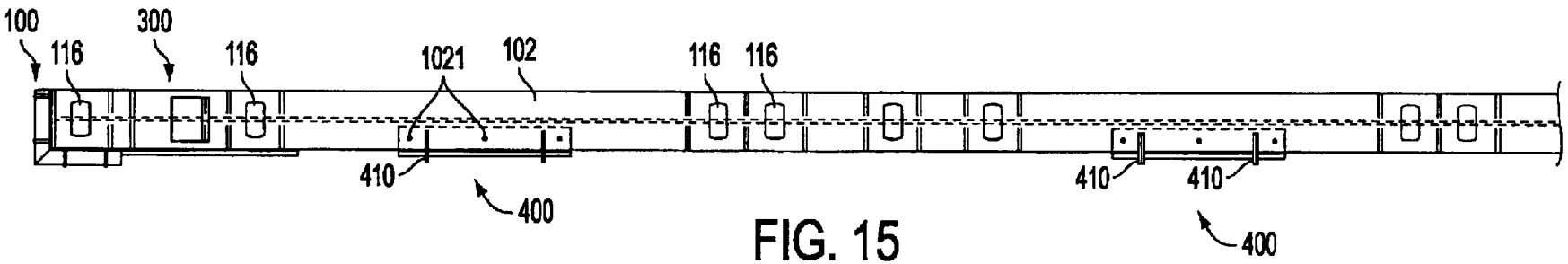
FIG. 15 is a plan view of an adaptive rail of the type shown in FIG. 14.

These skirtlets 400 are connected at spaced intervals in the manner best seen in FIGS. 14 and 15.

Figure 19:
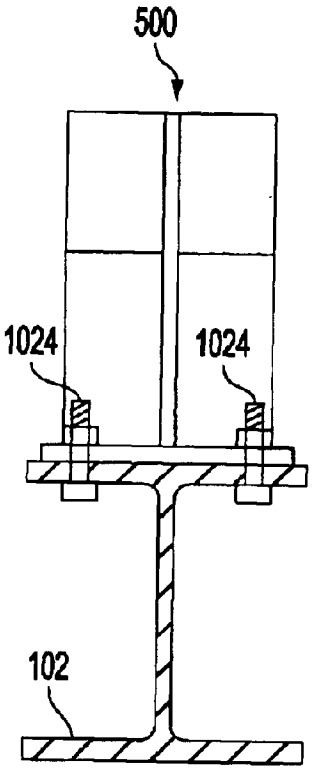
FIG. 19 is a sectional view taken along section line 19—19 of FIG. 18.
Figure 18:
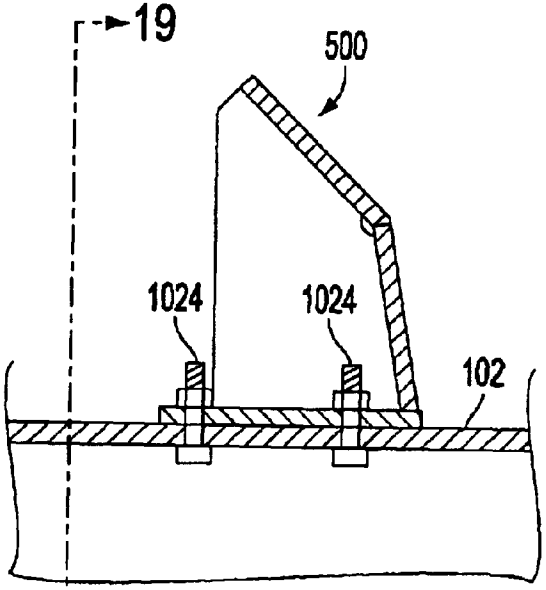
FIG. 18 is a side sectional view showing the detachable version of the top guide bracket depicted in FIGS. 14 and 15.

FIGS. 18 and 19 show a detachable top guide 500. This top guide 500 is similar to the top guide 300 shown in FIGS. 1–4 and differs in that it is detachably connected to the I-beam 102. Four bolts 1024 are used in this instance to secure the top guide 500 to the upper side of the I-beam 102.

Figure 13:
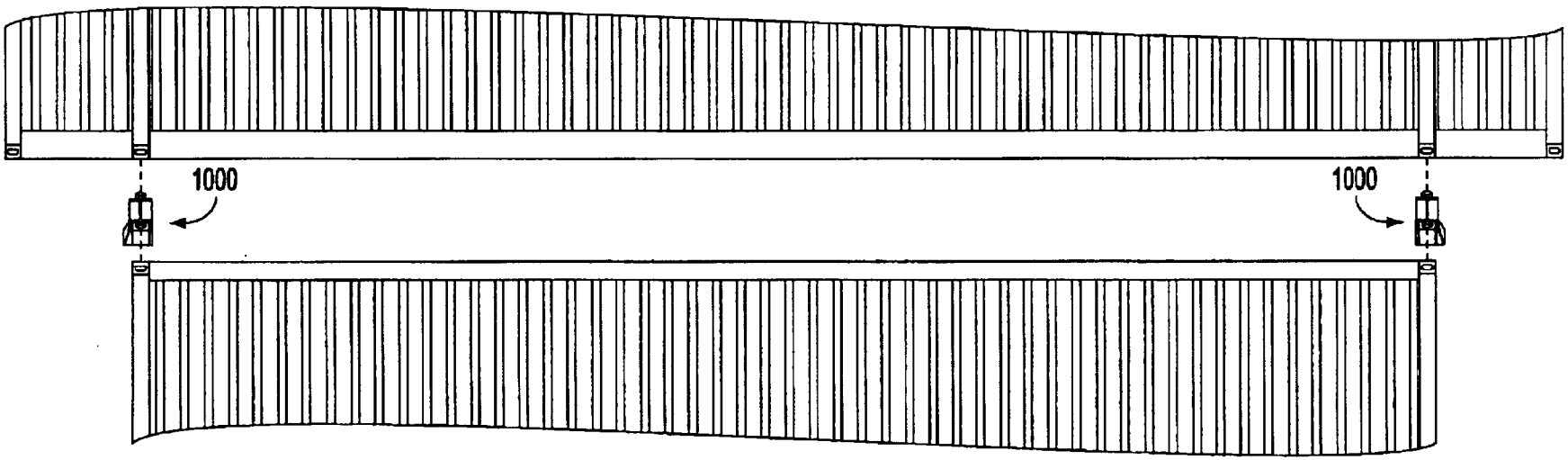
FIG. 13 is an end view of a row of containers showing how containers can be loaded on the adaptive rails according to the embodiments of the invention, in a manner which enables an overhang.

FIG. 13 shows a container disposition technique which can be used effectively to avoid the need to modify the hatches on a container ship. In the event that the hatches are sized to permit the stacking of rows of container having a first size in a conventional manner, with the adaptive rails of the invention, it is possible to arrange the containers in the manner depicted in FIG. 13. That is to say, as shown the adaptive rails 1000 permit a container of the type illustrated, to be lowered onto the adaptive rails 1000 and locked in place on top of containers which have smaller corresponding dimensions. This enables the illustrated overhang.

Figure 16:
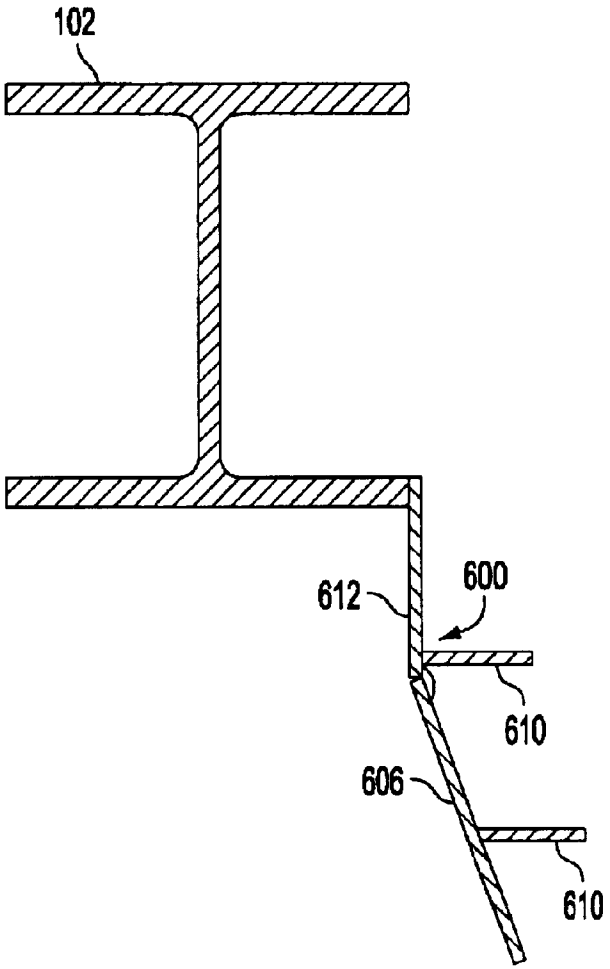
FIG. 16 is a sectional view of adaptation beam showing a variant of the corner guide depicted in FIGS. 14 and 15.
Figure 20:
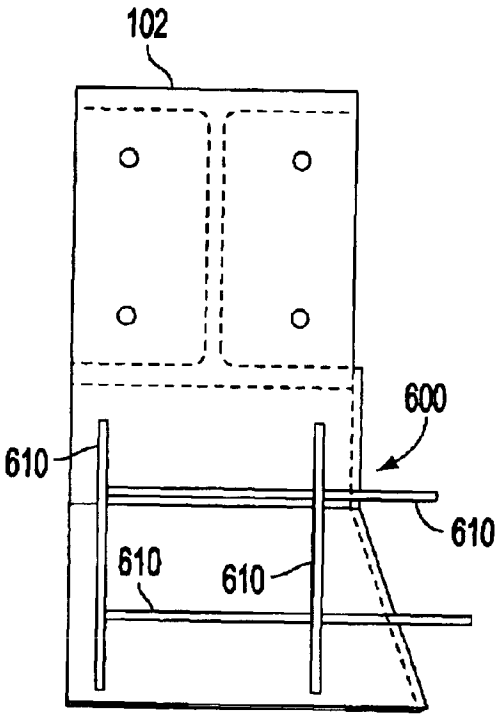
FIG. 20 is an end view of the corner guide shown in section in FIG. 16, depicting the manner in which the reinforcing ribs are arranged to intersect to provide rigidity and strength.

FIGS. 16 and 20 show a corner guide variant 600 which features ribs 610 which extend both horizontally as well as vertically, and intersect with each other to provide a highly rigid reinforcement to the overall structure. In FIGS. 16 and 17 the numerals 606, 612, 402 and 404 denote elements which respectively correspond to elements 106, 112, 202 and 204, shown in FIGS. 6 and 7.

While this invention has been disclosed with reference to only a limited number of embodiments, the various modifications and variations that can be envisaged and produced by a person of skill in the art to which the invention pertains or most closely pertains, will be self-evident given the proceeding disclosure. The scope of the invention is limited only by the appended claims.

What is claimed is:

1. A method of stacking containers comprising the steps of:

forming a first row of first containers;

guiding rails, using corner guides which are provided directly on at least one end of each rail and which are each formed of intersecting flat plates and which each have an external edge at an intersection of the intersecting flat plates that extends diagonally down and away with respect to a lower surface of each rail, to selected positions on opposite edges of the first row of first containers;

interconnecting first connection features on the rails to connection features on the first containers;

laying a second row of second containers on the rails; and interconnecting second connection features on the rails to connection features on the second containers.

2. A method of stacking containers comprising the steps of:

forming a first row of first conventional containers;

guiding first rails to selected positions on opposite edges of the first row of first containers;

interconnecting first connection features on the first rails to connection features on the first containers;

laying a second row of second conventional containers on the first rails; and interconnecting second features on the rails to connection features on the containers, wherein the step of guiding comprises the steps of:

providing a downwardly depending outwardly flared essentially frusto hemi-pyramidically-shaped corner guide at one end of each of the first and second rails, each said corner guide being configured to extend at an obtuse angle out, beyond and below an end face of the respective end of the rail on which it is disposed;

lowering the rails toward the first row of first containers;

engaging the corner guides on the rails with corners of an endmost container of the first row of first containers; and using the corner guides to force the rails to the selected position wherein connection features on the first row of first containers mate with the first connection feature on the rails as the rails continue to be lowered down onto the first row first containers.

3. A method as set forth in claim 2, wherein the step of guiding further comprises the steps of:

providing a downwardly depending outwardly flared skirt along at least a portion of a side of the rails;

engaging the sides of the first row of first containers with the skirts; and using the skirts to force the rails laterally with respect to the first row of first containers and toward the selected positions as the rails continue to be lowered down onto the first row of first containers.

4. A method as set forth in claim 2, further comprising the steps of:

providing a top guide on each rail proximate the end to which the corner guide is attached; and positioning each top guide so that an angled surface provided thereon is engageable with an endmost container of the second row of second containers as it is lowered toward the rails and for forcing the endmost container to a preselected position with respect to the first row of first containers.

5. A method as set forth in claim 2, wherein the step of laying the second row of second containers comprises aligning containers which have one of a different width and a different length from the containers which are aligned to form the first row of first containers.

6. A method as set forth in claim 2, wherein the outwardly flared corner guide comprises:

a first flat plate which is angled with respect to one of the end and side surfaces of the rail to which the outwardly flared corner guide is connected; and at least one reinforcing rib rigidly fixed to an outer surface of the plate which faces away from a container with which the first first plate is engageable.

7. A method as set forth in claim 6, further comprising:

a second flat plate which is connected to the first plate and which is interposed between the first plate and the rail to which the outwardly flared corner guide is connected, and wherein the at least one reinforcing rib is also rigidly fixed to the second flat plate.

8. An apparatus for stacking a first row of first conventional containers on top of a second row of second conventional containers wherein at least one of the containers of the second row of second containers has one of a different width and a different length from at least one of the containers of the first row of first containers, the stacking apparatus comprising:

a pair of rails each adapted to seat along a side of the second row of second containers, each of the pair of rails having an end and a lower surface;

a downwardly depending outwardly flared essentially frusto hemi-pyramidically-shaped corner guide at one end of each of the rails, each said downwardly extending corner guide being configured to extend at an angle out and beyond the respective end and lower surface of the rail on which it is disposed and configured to engage a corner portion of an end container of the second row of second containers and to force the ends of the rails to a predetermined seating position on the end container as the rails are lowered down toward the second row of second containers.

9. An apparatus as set forth in claim 8, further comprising:

a downwardly depending outwardly flared skirt extending along at least a portion of the length of each rail, the skirt on each rail being respectively adapted to engage an upper edge surface of at least one of the second row of second containers and to force the rail toward the predetermined seating position on the second row of second containers.

10. An apparatus as set forth in claim 9, wherein the skirt is detachably connected to the rail.

11. An apparatus as set forth in claim 9, wherein the skirt is formed essentially along the full length of the rail.

12. An apparatus as set forth in claim 9, wherein the skirt is formed as skirt sections which are disposed along predetermined portions of the rail.

13. An apparatus as set forth in claim 8, further comprising a top guide member secured to an upper edge of each of the pair of rails, each top guide member having an angled surface adapted to engage a lower edge portion of an end container of the first row of first containers and to guide the end container of the first row of first containers toward a predetermined seating position on top of the pair of rails wherein connection features on the end container of the first row of first containers mate with connection features on the pair of rails.

14. An apparatus as set forth in claim 8, wherein the downwardly depending outwardly flared corner guide comprises:

a first flat plate which is angled with respect to one of the end and side surfaces of the rail to which the outwardly flared corner guide is connected; and at least one reinforcing rib rigidly fixed to a surface of the plate which faces away from a container with which it is engageable.

15. A method as set forth in claim 14, further comprising:

a second flat plate which is connected to the first plate and which is interposed between the first plate and the rail to which the outwardly flared corner guide is connected, and wherein the at least one reinforcing rib is also rigidly fixed to the second flat plate.

16. An apparatus for stacking first containers on top of second containers, the stacking apparatus comprising:

first and second elongated rails each rail having:

at least one essentially frusto hemi-pyramidically-shaped guide member connected to an end of each of the first and second elongate rails for engaging a portion of one of the first and second containers and for forcing the first and second elongated rails to move into a predetermined seating position with respect to the other of the first and second containers as the first and second rails approach the one of the first and second containers and as the at least one guide member on each of the first and second rails, initially engages the one of the first and second containers.

17. An apparatus as set forth in claim 16, wherein the at least one guide member is detachably connected to each of the first and second rails.

18. An apparatus as set forth in claim 16, wherein the first and second containers have different sizes.

19. An apparatus as set forth in claim 16, wherein the at least one guide member is a corner guide member which is connected to a rail end and which has first and second guide surfaces that extend downwardly and away from the rail to which the at least one guide member is attached, that are respectively parallel to an end edge and a side edge of the rail to which the first and second guide surfaces are attached and which intersect to form an angled edge.

20. An apparatus as set forth in claim 16, wherein the at least one guide member is a skirt member which extends along at least a portion of the rail to which the skirt member is attached.

21. An apparatus as set forth in claim 16, wherein the at least one guide member comprises a plurality of skirts which extend down and away from the rail to which the skirts are connected and which are spacedly disposed along the length of the rail.

22. An apparatus as set forth in claim 21, wherein the plurality of skirts are detachably connected to the rail.

23. An apparatus as set forth in claim 16, wherein the at least one guide member is a top guide member which is secured to an upper surface of the rail to which it is attached and which has an angled surface which is oriented upwardly at a predetermined angle.

24. An apparatus as set forth in claim 23, wherein the top guide member is detachably connected to the rail.

25. An apparatus as set forth in claim 16, further comprising:

a plurality of first mounting fixtures for aligning and releasably connecting each of the first and second rails to the one of the first and second containers.

26. An apparatus as set forth in claim 16, wherein the at least one guide member comprises a downwardly and outwardly extending guide member which extends outwardly and beyond at least one of the end and side of the rail to which guide member is fixed.

27. A method as set forth in claim 26, wherein the downwardly and outwardly extending guide member comprises:

a first flat plate which is angled with respect to one of the end and side surfaces of the rail to which the outwardly flared corner guide is connected; and at least one reinforcing rib rigidly fixed to an external surface of the plate which faces away from a container with which the plate is engageable.

28. A method as set forth in claim 27, further comprising:

a second flat plate which is connected to the first plate and which is interposed between the first plate and the rail to which the outwardly flared corner guide is connected, and wherein the at least one reinforcing rib is also rigidly fixed to the second flat plate.

29. An apparatus for stacking first containers on top of second containers, the stacking apparatus comprising:

an elongate rail having a corner guide comprising:

a first flat plate which is angled down and away with respect to one of an end and a side surface of the rail; and at least one first reinforcing rib rigidly fixed to an outer surface of the first plate which faces away from a container with which the first flat plate is engageable.

30. An apparatus as set forth in claim 29, further comprising:

a second flat plate which is angled down and away with respect to another of the end and side surfaces of the rail and which is connected to the first flat plate to form a frusto hemi-pyramidically shaped configuration, and at least one second reinforcing rib rigidly fixed to an outer surface of the second flat plate.

31. An apparatus as set forth in claim 30, further comprising:

a third flat plate which is connected to the first plate and which is interposed between the first plate and the rail and connected to the rail, and wherein the at least one reinforcing rib is also rigidly fixed to the second flat plate.

32. An apparatus as set forth in claim 31, further comprising:

a fourth flat plate which is connected to the second plate and which is interposed between the second plate and the rail and connected to the rail, and wherein the at least one reinforcing rib is also rigidly fixed to the fourth plate.

33. An apparatus as set forth in claim 29, further comprising:

a side skirt comprising:

a first flat skirt plate which extends down and away from a side edge of the rail, and at least one skirt rib which is fixed to an external surface of the skirt plate which faces away from a container with which it is engageable.

34. An apparatus as set forth in claim 33, further comprising a second flat skirt plate which is interposed between the rail the first flat skirt plate and which interconnects the first flat skirt plate to the rail, and wherein the at least one skirt rib is fixed to an external surface of the second flat skirt plate.

35. An apparatus as set forth in claim 29, further comprising:

a top guide member comprising:

a flat top guide plate which is angled with respect to an upper surface of the rail; and a central web which is arranged normally with respect to the flat top guide plate and which interconnects the flat top guide plate with the rail.

36. An apparatus as set forth in claim 35, wherein at least one of the corner guide, the side skirt, and the top guide member disconnectably fastened to the rail.

* * * * *